US008475351B2

(12) United States Patent
Aizawa

(10) Patent No.: US 8,475,351 B2
(45) Date of Patent: Jul. 2, 2013

(54) CENTRIFUGE HAVING A SEAL MECHANISM

(75) Inventor: Masaharu Aizawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 918 days.

(21) Appl. No.: 12/563,269

(22) Filed: Sep. 21, 2009

(65) Prior Publication Data

US 2010/0081553 A1 Apr. 1, 2010

(30) Foreign Application Priority Data

Sep. 30, 2008 (JP) ..... 2008-255740

(51) Int. Cl.
*B04B 15/00* (2006.01)

(52) U.S. Cl.
USPC ..... 494/15; 494/41; 494/47

(58) Field of Classification Search
USPC ..... 494/38–41, 47–48, 43, 61, 67–74, 494/15
See application file for complete search history.

(56) References Cited

U.S. PATENT DOCUMENTS

| | | | | | |
|---|---|---|---|---|---|
| 3,430,849 | A * | 3/1969 | Nunley et al. | ..... | 494/12 |
| 3,498,531 | A * | 3/1970 | Chervenka et al. | ..... | 494/26 |
| 3,602,425 | A * | 8/1971 | Schmidt | ..... | 494/14 |
| 3,708,111 | A * | 1/1973 | Sheeler et al. | ..... | 494/37 |
| 3,724,748 | A * | 4/1973 | Jacobson | ..... | 494/11 |
| 3,765,601 | A * | 10/1973 | Gulley | ..... | 494/38 |
| 3,843,045 | A * | 10/1974 | Schmidt et al. | ..... | 494/27 |
| 3,843,046 | A * | 10/1974 | Joyce | ..... | 494/37 |
| 3,899,128 | A * | 8/1975 | Joyce | ..... | 494/67 |
| 4,011,972 | A * | 3/1977 | Pederson et al. | ..... | 494/41 |
| 2010/0081553 | A1 * | 4/2010 | Aizawa | ..... | 494/14 |

* cited by examiner

*Primary Examiner* — Charles E Cooley
(74) *Attorney, Agent, or Firm* — Antonelli, Terry, Stout & Kraus, LLP.

(57) ABSTRACT

The present invention provides a zonal centrifuge which has superior workability and functionality when a sample is filled and extracted. An oil bearing fitted to an outer circumference of a lower tube of a rotor is arranged on an internal face of a bearing housing fixed over a door adapter of the centrifuge. As the oil bearing and the lower tube are lubricated, a vacuum environment in a rotor rotating chamber is maintained. A rotating seal located at an upper leading end of the lower tube of the rotor and a fixing seal facing the rotating seal are arranged and provided in a sealed space formed by a mechanical seal member and the bearing housing, and the fixing seal is so manipulated as to be able to freely join and separate from the rotating seal.

22 Claims, 7 Drawing Sheets

FIG. 7

CONVENTIONAL ART

| STEP / ITEM | SAMPLE FILLING | CENTRIFUGAL SEPARATION | COLLECTION OF SAMPLE |
|---|---|---|---|
| CONDITION OF DEVICE | 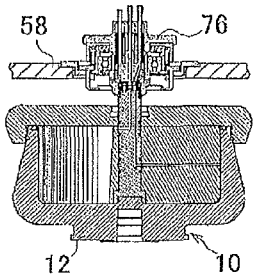  (DRIVEN WHILE OPENED TO THE ATMOSPHERE) | 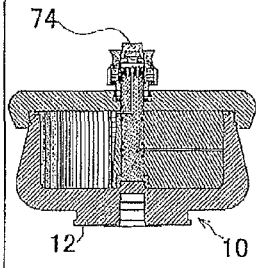  (ROTOR ROTATION CHAMBER IS DEPRESSURIZED) | 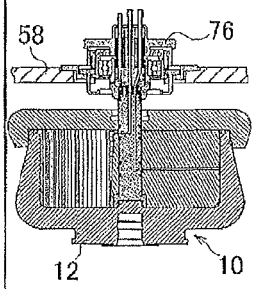  (DRIVEN WHILE OPENED TO THE ATMOSPHERE) |
| ROTATION SPEED | e.g. 3,000 rpm | PREDETERMINED ROTATION SPEED (ROTATING AT HIGH SPEED) | e.g. 3,000 rpm |
| CONTENT OF STEP | FILLING OF DENSITY GRADIENT LIQUID AND SAMPLE | SEPARATING SAMPLE | COLLECTING SAMPLE AFTER SEPARATION |

CENTRIFUGE HAVING A SEAL MECHANISM

BACKGROUND OF THE INVENTION

1. Field of the Invention

The present invention relates to a centrifuge which separates, by centrifugation, fine particles in a liquid sample in which separation-target particles are mixed.

2. Description of the Related Art

In the fields of biology, medical science, agriculture, and the like, a zonal centrifugation method is used in order to separate fine particles like intracellular materials or viruses. According to the zonal centrifugation method, one which is called a swing rotor (or swinging bucket rotor) and which rotates with a plastic test tube filled with a sample being inserted into a bucket of the rotor is used.

A product so-called a zonal rotor is also sold and used instead of the swing rotor. As such a product, a P35ZT-type zonal rotor made by Hitachi Koki, Co., Ltd. is commercially available. The zonal rotor has characteristics such that it has little turbulence of a sample since there is no "wall effect", has a large capacity, and continuously allows filling of a sample, collection thereof and analytical operation when rotating in comparison with the swing rotor. The zonal rotor is mainly used for separation needing a great capacity and a high precision like vaccine production. An explanation will now be given of a configuration of a conventional centrifuge having the zonal rotor.

FIGS. 5A and 5B are diagrams showing a whole configuration of a conventional centrifugal separation device (hereinafter, "centrifuge") 51*a* having a zonal rotor (hereinafter, "rotor") 10. FIG. 5A shows a state when a sample is filled/collected, while FIG. 5B shows a state when centrifugal separation is carried out. As shown in FIG. 5A, the centrifuge 51*a* comprises a driving unit 53, the rotor 10 and a rotor rotation chamber 55 all arranged inside a casing 52 formed of sheet-metal parts, a control panel 57 indicating a driving state, and, an electrical control unit 60, a vacuum evacuation device 62, and a rotor-chamber-interior cooling device 64 which are illustrated with a simplified contour respectively in the figure.

The rotor 10 stores a separation-target sample 184 shown in FIG. 6, and as the rotor 10 is rotated and driven by the driving unit 53, the rotor 10 separates the sample 184 in such a way that the sample 184 forms layers in the radial direction. As shown in FIGS. 5A, 5B and FIG. 6, the rotor 10 mainly comprises a bowl-like rotor body 12, partition walls (hereinafter, "septa") 16*a* arranged in the rotor body 12 and dividing a sample storage chamber 18 into sector forms as viewed from the above, and a cover 14*a* having a female thread fastened with a male thread provided on an upper external face of the rotor body 12, functioning as a lid, and provided with an opening at the center thereof where a shaft 70*a* passes all the way through.

As shown in FIG. 6, the shaft 70*a* is formed in a cylindrical shape, and a lower end thereof is fixed to an internal bottom face of the rotor body 12. An upper end of the shaft 70*a* is attached with a rotating seal (first sealing member) 72 used for taking out/putting in the sample 184. The shaft 70*a* has a sample passageway 300 and an extrusion liquid passageway 320. The sample passageway 300 runs from an opening formed in the upper end of the shaft 70*a* to an opening formed in a side face of the shaft 70*a* and located in the interior of the rotor 10. The extrusion liquid passageway 320 penetrates the septa 16*a* in the radial direction of the rotor 10 from the upper end of the shaft 70*a*, and is communicated with a space between the rotor 10 and the septa 16*a*.

When centrifugal separation is carried out, the rotor 10 is mounted in such a way that a rotation shaft opening 120 shown in FIG. 6 is connected to a rotation shaft 54 provided upwardly of the driving unit 53 shown in FIG. 5A. Thereafter, in accordance with the steps and procedures shown in FIG. 7, the centrifuge 51*a* is operated. Then, a target is separated by centrifugation and collected. An explanation will be given of operation steps of the rotor 10 with reference to FIG. 7.

At a step of "filling a sample", a seal member 76 is attached with the rotor 10 being rotating at about 3000 rpm in an atmosphere. The seal member 76 is caused to contact and slide the rotating seal 72 of the rotor 10 to configure a mechanical seal. Next, using a liquid-feeding pump (not shown), a separation-target sample 184 and a density gradient liquid necessary for separating the sample 184 are filled. The seal member 76 is attached to a seal supporting plate 58 attached in the rotor rotation chamber 55 in such a manner as to be coaxial with a rotation axis of the rotor 10. Thereafter, the sample 184 is filled into a central part of the rotor 10 through the sample passageway 300 shown in FIG. 6, and then a preparation for centrifugal separation is completed. This operation is carried out with a door 56*a* of the centrifuge 51*a* being opened.

Next, at a step of "centrifugal separation" shown in FIG. 7, the seal member 76 is removed, and a cap 74 is attached to a leading end of the shaft 70*a* shown in FIG. 6 in order to airtightly sealing the interior of the rotor 10. The cap 74 is attached to the upper end of the shaft 70*a* while being sealed with an O-ring or the like. When the rotor 10 is rotated at high speed to perform centrifugal separation on the sample 184, the door 56*a* is closed, the rotor rotation chamber 55 is vacuumed (depressurized) by the vacuum evacuation device 62 shown in FIG. 5A, so that generation of heats due to friction of the rotor 10 with the air is suppressed. However, when the centrifuge 51*a* is operated under a depressurized condition, the sample 184 in the rotor 10 is likely to be evaporated. The cap 74 is used in order to suppress such evaporation. Next, the rotor rotation chamber 55 is vacuumed, the rotation speed of the rotor 10 is increased to a predetermined rotation speed, and centrifugal separation with a time appropriate for separation of the sample 184 is carried out.

After the centrifugal separation, at a step of "collecting the sample" shown in FIG. 7, the rotation speed of the rotor 10 is reduced again to 3000 rpm, and the pressure of the rotor rotation chamber 55 is returned back to the atmospheric pressure. Thereafter, the door 56*a* is opened, the cap 74 is removed, the sealing member 76 is attached again, and the separated liquid in the rotor 10 is collected. For example, in the case of sample collection at 3000 rpm, a liquid having a large density (hereinafter, "extrusion liquid") is fed from an external wall side in the rotor 10 through the extrusion liquid passageway 320 of the shaft 70*a*. The sample 184 is ejected to the exterior through the sample passageway 300 of the shaft 70*a*, and collected. A density gradient liquid containing settled-out particles can be dividingly collected by a fraction collector while continuously measuring a light absorption degree by a spectrophotometrical meter. At this time, the sealing member 76 and the rotating seal 72 at the rotor 10 side contact with each other, so that sealing is accomplished in order to suppress any leakage of the liquid.

As explained above, such a centrifuge is used for the purposes of virus purification to produce a vaccine and elimination of fever-inducing agents. Specific examples of the sample 184 are influenza viruses, Japanese B encephalitis viruses, whooping-cough viruses, AIDS viruses, and hepatitis viruses, and a staring ingredient thereof is a cell picked up form a culture fluid or an animal, or one suspended in a liquid like a biological fluid.

U.S. Pat. No. 4,011,972 discloses a continuous flow centrifugal separation rotor which performs centrifugal separation while allowing a sample to be continuously flowed into a rotor which is rotating at high speed. A rotor main body is arranged in a rotor rotation chamber, and a mechanical seal member is arranged outwardly of a door of a centrifuge. A journal bearing is provided around an outer circumference of a tube member extending upwardly from the rotor and having plural sample passageways. A space between the outer circumference of the tube and the bearing is lubricated by a lubricant. The lubricant functions to disconnect the interior of the rotor rotation chamber and the exterior thereof, and to maintain a vacuum environment in the rotor rotation chamber. One mechanical seal member has a sealing configuration that a rotating seal and a fixation seal always contact with each other. According to U.S. Pat. No. 4,011,972, a sample is continuously filled in at a predetermined flow rate and collected while the rotor is in a high-speed rotation condition, so that such a rotor is called a continuous flow rotor. An example of such a commercially available rotor is a P32CT-type continuous rotor made by Hitachi Koki Co., Ltd.

According to the zonal centrifuge, it requires an attachment/removal work of a cap and a seal member to a shaft which is rotating in conjunction with a rotor. Such a work to the rotating shaft cannot be carried out efficiently if an operator is not skilled well even if the rotor is rotated at a low rotation speed.

Moreover, according to the conventional centrifuge 51*a*, when a density gradient liquid and an extrusion liquid are filled and when the sample 184 is filled or collected, the rotor rotation chamber 55 is kept in an atmospheric pressure (with the door 56*a* being opened). Accordingly, airs flow into the rotor rotation chamber 55, so that the interior of the rotor rotation chamber 55 is subjected to dew condensation, or temperature control becomes imperfect.

Further, according to the continuous rotor disclosed in U.S. Pat. No. 4,011,972, since the seal member is always in a contact condition, the seal member is easily worn, and a lifetime thereof is short.

SUMMARY OF THE INVENTION

The present invention has been made in view of the foregoing circumstances, and it is an object of the present invention to provide a zonal centrifuge having superior workability and functionality.

To accomplish the object of the present invention described above, a centrifuge according to a first aspect of the present invention comprises:

a rotor having a sample storage chamber for storing a sample;

a rotor rotation chamber in which the rotor is provided;

a driving unit rotating the rotor;

a first tube which has one end connected to the sample storage chamber, and has a first passageway and a second passageway, the first passageway being for filling a density gradient liquid and the sample in the sample storage chamber and collecting the sample in the sample storage chamber, and the second passageway being for filling a liquid pushing out the sample in the sample storage chamber to the first passageway;

a first seal member which is connected to another end of the first tube, and has a first opening and a second opening communicated with the first passageway and the second passageway, respectively;

a second seal member which is so arranged as to face the first seal member, and has a third opening and a fourth opening which face the first opening of the first seal member and the second opening thereof, respectively;

a second tube which has a third passageway having one end connected to the second seal member and communicated with the third opening, and a fourth passageway communicated with the fourth opening; and a joining/separating member which joins and separates the first seal member and the second seal member.

As the first seal member and the second seal member are joined together by the joining/separating member, the first passageway and the first opening become communicated with the third opening and the third passageway, and the second passageway and the second opening become communicated with the fourth opening and the fourth passageway, so that the sample storage chamber of the rotor becomes accessible through the third passageway and the fourth passageway; and as the first seal member and the second seal member are separated from each other by the joining/separating member, the first passageway and the first opening are separated from the third opening and the third passageway, and the second passageway and the second opening are separated from the fourth opening and the fourth passageway.

For example, the joining/separating member comprises:

a first supporting member arranged over the rotor, and rotatably supporting the first tube; and a second supporting member which movably supports the second tube in a direction toward the first tube and in a direction apart from the first tube; and an operation member, and wherein the second seal member moves in accordance with a manipulation of the operation member, and abuts and slides the first seal member which is rotating along with rotation of the rotor.

The first supporting member may comprise:

a bearing which is arranged over the rotor, and rotatably supports the first tube; and a bearing supporting member formed in a cylindrical shape, and having an internal face supporting the bearing, the second supporting member may comprise:

a cylindrical sleeve which has one end connected to the bearing supporting member, and has another end provided with a threaded face;

a tube fixing member which is formed in a cylindrical shape, has an internal face fixing the second tube, has one end slidably fitted to an internal face of the sleeve, and has another end provided with a larger-diameter part; and an elastic member arranged between the sleeve and the larger-diameter part of the tube fixing member, and urging the tube fixing member toward a direction apart from the first tube, and the operation member is formed in a cylindrical shape, has one end provided with a threaded face corresponding to the threaded face of the sleeve, and has another end provided with an abutment part which abuts another end of the tube fixing member.

As the operation member is fastened to the sleeve, the joining/separating member causes the abutment part of the operation member to abut another end of the tube fixing member and to push the tube fixing member, causes the tube fixing member to move the second tube and the second seal member connected to the second tube in a direction toward the first tube, and causes the second seal member to abut and slide the first seal member which is rotating along with rotation of the rotor; and as the operation member is loosened from the sleeve, the joining/separating member causes the tube fixing member to be urged in a direction opposite to an axis of the first tube, causes the tube fixing member, the second tube and the second seal member connected to the second tube to move in a direction apart from the first tube, and causes the second seal member to be apart from the first seal member which is rotating along with the rotation of the rotor.

A lubricant filled in a space between the first tube and the bearing may separate the rotor rotation chamber from atmosphere, thus a depressurized condition may be maintained when an interior of the rotor rotation chamber is depressurized.

The first seal member may be provided in a sealed space.

The sealed space may be formed by the first tube, the bearing, the bearing supporting member, and the second seal member.

It is desirable that two openings which are communicated with the sealed space should be formed in the bearing supporting member;

one opening should allow air passing through a filter to flow in;

another opening should suction the air; and the air suctioned through another opening should be exhausted through another filter.

It is desirable that a member contacting the sealed space should be formed of a metal or a plastic which is a tolerant of heat at 121° C.

It is desirable that the bearing supporting member should have openings which reaches the bearing and from which a lubricant is supplied and/or collected.

Furthermore, it is desirable that the bearing supporting member should have an opening which reaches the bearing and from which a coolant is supplied.

A centrifuge according to a second aspect of the present invention comprises:

a rotor having a sample storage chamber for storing a sample;

a rotor rotation chamber in which the rotor is provided;

a driving unit rotating the rotor;

a first tube which has one end connected to the sample storage chamber, and has another end where a first seal member is provided;

a second tube so arranged as to face the first tube;

a second seal member arranged at one end of the second tube; and a joining/separating member which joins and separates the first seal member and the second seal member with the rotor rotating chamber being in a depressurized condition.

A centrifuge according to a third aspect of the present invention comprises:

a rotor having a sample storage chamber for storing a sample;

a rotor rotation chamber in which the rotor is provided;

a driving unit rotating the rotor;

a depressurizing unit depressurizing the rotor rotation chamber;

a first seal member which has a opening for filling a density gradient liquid and the sample in the sample storage chamber and collecting the sample in the sample storage chamber; and a second seal member which is so arranged as to face the first seal member, wherein the first seal member joins and separates from the second seal member with the rotor rotating chamber being in a depressurized condition.

According to the present invention, it becomes possible to provide a centrifuge having superior workability and functionality.

BRIEF DESCRIPTION OF THE DRAWINGS

The object and other objects and advantages of the present invention will become more apparent upon reading of the following detailed description and the accompanying drawings in which:

FIG. 7 is a diagram showing procedures how to use the conventional centrifuge.

DETAILED DESCRIPTION OF THE PREFERRED EMBODIMENT

An explanation will be given of a centrifuge according to an embodiment of the present invention with reference to accompanying drawings. In order to clarify the explanation for the embodiment of the present invention, in a relationship between a tube and a rotor, a tube side is called an upward direction and a rotor side is called a downward direction in the embodiment.

Figure 1:
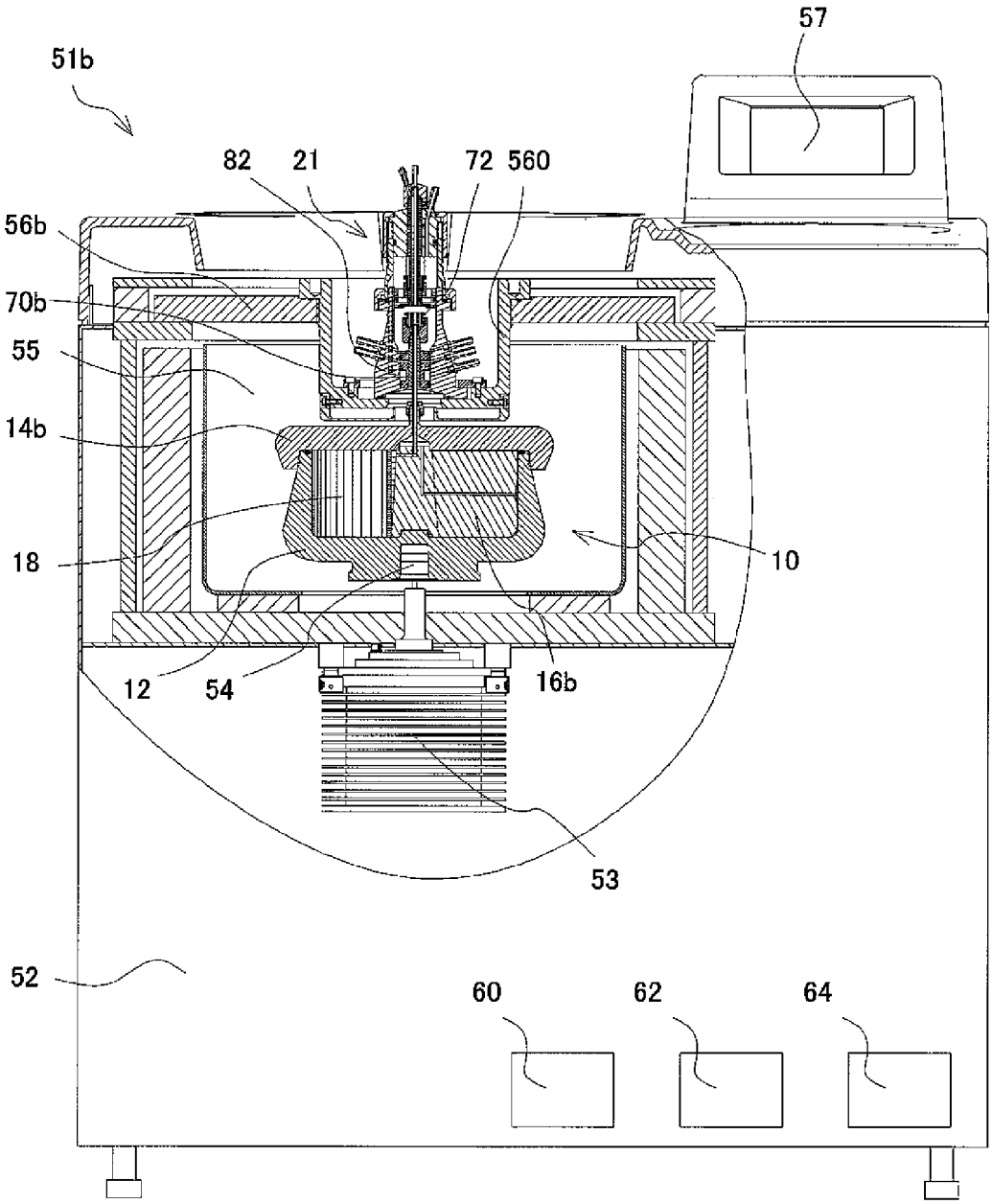
FIG. 1 is a diagram showing a whole configuration of a centrifuge according to an embodiment of the present invention.

As shown in FIG. 1, a centrifuge 51 comprises a casing 52 formed of sheet-metal parts, a driving unit 53, a rotor 10, and a rotor rotation chamber 55 all arranged in the casing 52, a control panel 57 indicating an operating condition, and, an electrical control unit 60, a vacuum evacuation device 62 and a rotor-chamber-interior cooling device 64 which are illustrated with a simplified contour respectively in the figure.

Figure 2A:
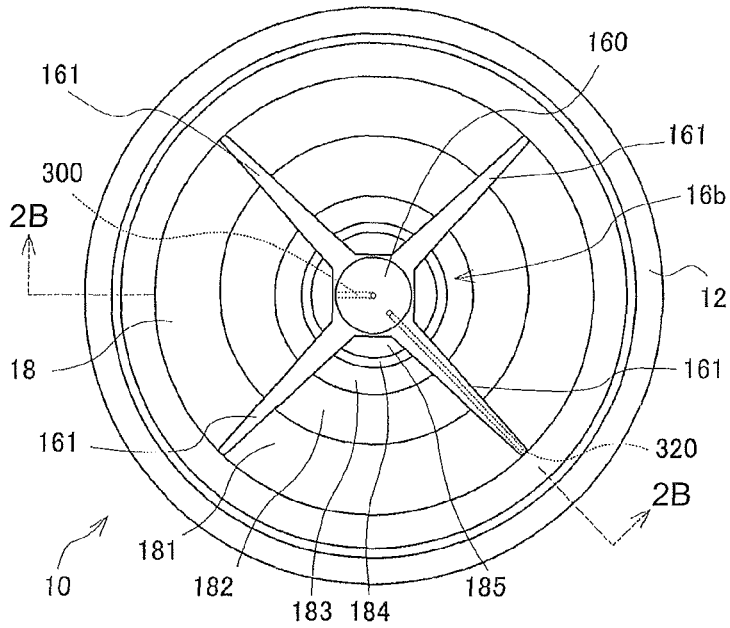
FIG. 2A is an exemplary horizontal cross-sectional view showing an interior of a rotor when a density gradient liquid is filled.
Figure 2B:
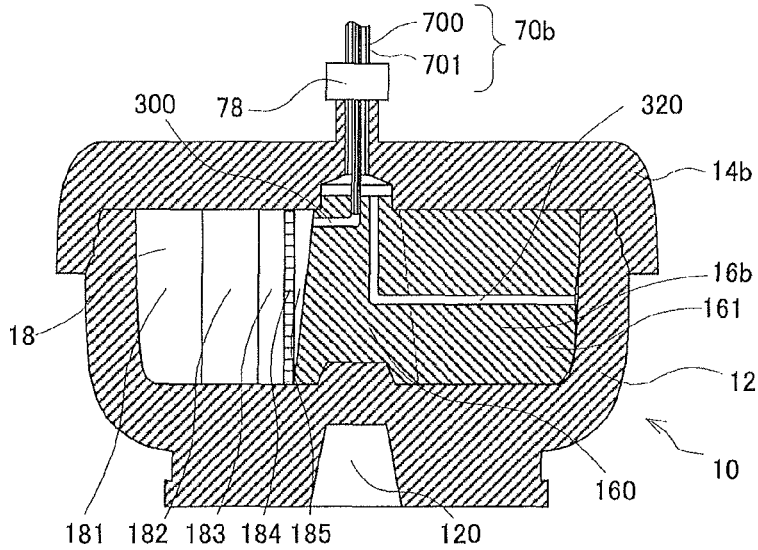
FIG. 2B is an exemplary vertical cross-sectional view showing the rotor when the density gradient liquid is filled and as viewed from a cross section of an arrow A-A in FIG. 2A.

The rotor 10 stores a sample 184 subjected to separation and as shown in FIGS. 2A, 2B. The rotor 10 is rotated and driven by the driving unit 53, and separates the sample 184 in such a way that the sample 184 forms layers in the radial direction. As exemplary shown in FIGS. 2A, 2B, the rotor 10 comprises a bowl-like rotor body 12, tabular septa 16*b* which divides a sample storage chamber 18 storing the sample 184 in the rotor body 12 into four sectors as viewed from the above as shown in FIG. 2A, and a cover 14b which is located above the rotor body 12 and functions as a lid. Individual parts will be explained below in more detail.

The rotor body 12 has a male thread formed at an upper end portion of an outer circumference of the bowl-like contour, and has a rotation shaft opening 120 formed in a bottom face of the rotor body 12 and threaded with a rotation shaft 54.

The septa 16*b* have a substantially cylindrical septa axis 160 and four plates 161 radially connected to the septa axis 160, and are formed in an integral shape. The septa 16*b* are arranged in the rotor body 12, and separates the sample storage chamber 18 into sector forms as viewed from above as shown in FIG. 2A. The septa 16*b* have an opening which runs downwardly from the center of an upper face of the septa axis 160 and is bent in an L-shape to a side face of the septa axis 160. This opening is a part of a sample passageway (first passageway) 300 to be discussed later for filling/collecting the sample 184 and a density gradient liquid to be discussed later. Moreover, an opening which runs downwardly from a part of the upper face of the septa axis 160 and is bent in an L-shape to a side face of the plate 161 facing the rotor body 12 is also formed. This opening is a part of an extrusion liquid passageway (second passageway) 320 for filling an extrusion liquid to be discussed later.

The cover 14*b* has a female thread fastened with the male thread of the rotor body 12. As the cover 14*b* airtightly seals the opened portion of the bowl-like rotor body 12, the sample 184 is stored. The sample storage chamber 18 is formed by the cover 14*b* and the rotor body 12. Further, the cover 14*b* has an opening formed at the center thereof. A lower tube (first tube) 70*b* to be discussed later is attached in this opening. A lower end of the lower tube 70*b* is guided into the interior of the rotor 10 through this opening.

Figure 3:
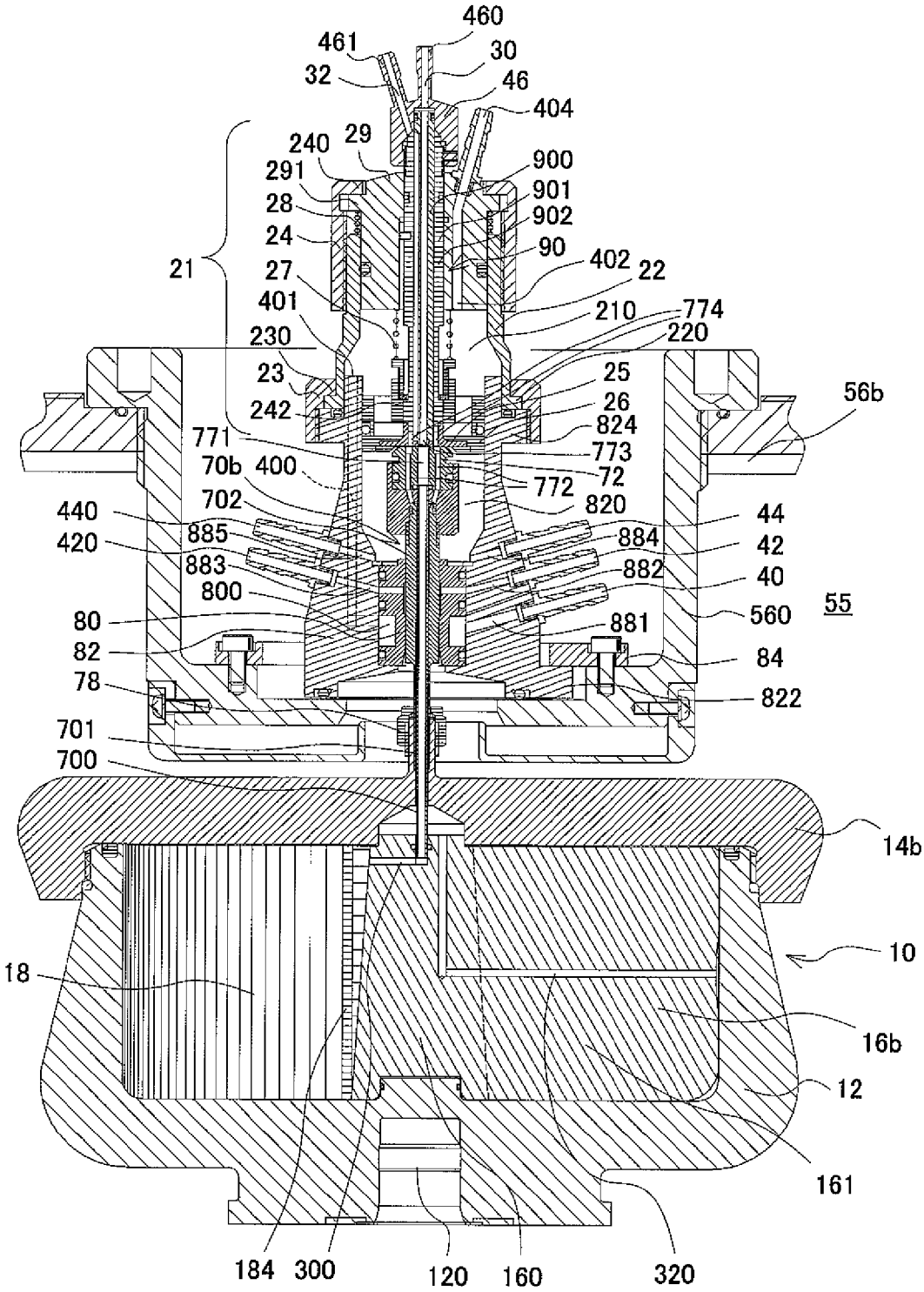
FIG. 3 is a front vertical cross-sectional view enlargingly showing main parts of the centrifuge of the embodiment of the present invention when a sample is filled/collected.

As shown in FIG. 3, the lower tube 70*b* has a dual-tube configuration comprised of a cylindrical inner tube 700 and a substantially cylindrical outer tube 701 having a larger-diameter part 702. The larger-diameter part 702 of the outer tube 701 is so formed as to have a large diameter as it can be appropriately fitted into an oil bearing 80 to be discussed later. The lower tube 70*b* passes all the way through the opening formed at the center of the cover 14*b*, and a lower end of the inner tube 700 is fitted into the opening formed in the upper face of the septa axis 160. The lower tube 70*b* is fixed to the cover 14*b* by a tube fixing nut 78. A rotating seal 72 (first seal member) which can be joined and separated from a fixing seal (second seal member) 25 provided at a seal member 21 (joining/separating member) to be discussed later is attached to an upper end of the lower tube 70*b*. The rotating seal 72 is formed in a substantially cylindrical shape. The rotating seal 72 has an opening (first opening) 771 which is communicated with the interior of the inner tube 700 and an opening (second opening) 772 which is communicated with a space between the inner tube 700 and the outer tube 701.

The rotating seal 72, the lower tube 70*b* and the septa 16*b* having the foregoing configurations form the sample passageway 300 which runs from an upper face of the rotating seal 72 to the upper face center of the septa axis 160 via the inner tube 700, runs downwardly from the upper face of the septa axis 160, is communicated with the opening bent in an L-shape toward the side face of the septa axis 160, and reaches the center of the sample storage chamber 18. Furthermore, also formed is the extrusion liquid passageway 320 which runs from the upper face of the rotating seal 72, passes through the space between an external face of the inner tube 700 and an internal face of the outer tube 701, runs downwardly from a part of the upper face of the septa axis 160, is communicated with the opening bent into an L-shape toward the side face of the plate 161 facing the rotor body 12, and reaches the sample storage chamber 18 in the vicinity of an internal face of the rotor body 12.

Next, an explanation will be given of the oil bearing 80 which separates the rotor rotation chamber in a vacuum condition from the atmosphere and a bearing housing (bearing supporting member) 82 which has a part for introducing a liquid cooling down a heat-generating part. Note that the oil bearing 80 and the bearing housing 82 configure a first supporting member.

A door 56*b* of the centrifuge 51*b* is attached with a bucket-like door adapter 560 which is a part where the bearing housing 82 is arranged. The door adapter 560 is attached in such a way that a protrusive portion thereof is fixed to the door 56*b* by a thread and the door adapter 560 protrudes downwardly of the door 56*b*. The bearing housing 82 formed in a substantially cylindrical shape is attached to an internal bottom face of the door adapter 560. The bearing housing 82 has a lower protrusive part 822 protruding outwardly at a bottom face thereof and has an upper protrusive part 824 protruding outwardly at an upper face. As a housing pushing plate 84 in abutment with an upper face of the lower protrusive part 822 is fastened to the internal bottom face of the adapter 560, the bearing housing 82 is held by the housing pushing plate 84 in a sandwiched manner. The upper protrusive part 824 has a male thread formed at a side face thereof, and is fastened with a lower collar 23 of the mechanical seal member 21 to be discussed later.

The oil bearing 80 is fixed to an internal face of the bearing housing 82. The larger-diameter part 702 of the outer tube 701 of the lower tube 70*b* is rotatably supported by the oil bearing 80 through a lubricant (lubricating agent) adhered to an internal face of the oil bearing 80. Further, a coolant inlet connector 40, a lubricant inlet connector 42, a lubricant outlet connector 420, an intake connector 44, and an airflow inlet connector 440 are attached to an external face of the bearing housing 82. Portions to which those connectors are attached are provided with openings 881, 882, 883, 884 and 885 which extend to an internal face of the bearing housing 82, respectively.

First, an explanation will be given of the function of the oil bearing 80 and that of the lubricant inlet connector 42. A space between the lower tube 70*b* and the oil bearing 80 is filled with a lubricant which is supplied from the lubricant inlet connector 42 and returns to the oil bearing 80 from the lubricant outlet connector 420. Further, the lubricant not only functions as a lubricating agent, but also functions to separate the rotor rotation chamber 55 from the atmosphere. That is, the lubricant always seals the space between the oil bearing 80 and the lower tube 70*b*. Accordingly, even if the rotor rotation chamber 55 is vacuumed when the rotor 10 is rotating at high speed, entering of an air from the upward of the rotor rotation chamber 55 is suppressed, and the vacuuming condition in the rotor rotation chamber 55 is maintained. A circumferential speed of the rotor 10 is about 20 m/s and is high if the maximum rotating speed of the rotor 10 is 35000 rpm, so that a temperature of the sliding part where the lower tube 70*b* and the oil bearing 80 are in contact with each other rises. An explanation will be given of the coolant inlet connector 40 which introduces a coolant that cools down the sliding part.

The coolant inlet connector 40 is attached to the external face of the bearing housing 82 as explained above. In the embodiment, the coolant inlet connector 40 is attached downwardly of the attached location of the lubricant inlet connector 42. As explained above, the opening 881 extends from the coolant inlet connector 40 toward an internal face of the bearing housing 82, and is communicated with the oil bearing 80. The oil bearing 80 has a recess 800 which has a smaller outer diameter than other outer diameters and is placed in a portion contacting a coolant supplied from the coolant inlet connector 40. The recess 800 increases a contacting area of the oil bearing 80 with the coolant, and is so formed that the coolant contacts a portion in the vicinity of the heat-generating sliding part between the oil bearing 80 and the lower tube 70*b*, thereby efficiently cooling down the oil bearing 80. Furthermore, the bearing housing 82 has a coolant opening 400 whose inlet is the coolant inlet connector 40 and whose outlet is a coolant outlet 401 to be discussed later opened in the mechanical seal member 21. The coolant opening 400 extends in the radial direction of the bearing housing 82 from the recess 800 of the oil bearing 80, is bent in an L-shape upwardly, and reaches the coolant outlet 401 formed in an upper face of the bearing housing 82.

Next, an explanation will be given of the configuration of the intake connector 44 and that of the airflow inlet connector 440 which are used for detecting any leakage from an attachment/detachment part between the rotating seal 72 and the fixing seal 25 to be discussed later. The intake connector 44 is attached to the bearing housing 82. The intake connector 44 is provided upwardly of the lubricant inlet connector 42. The opening 884 communicating with the intake connector 44 is communicated with a housing space (sealed space) 820 which locates above the oil bearing 80 and is partitioned by the fixing seal 25 to be discussed later of the mechanical seal member 21 and the bearing housing 82. The airflow inlet connector 440 is attached to a position which is symmetrical to the intake connector 44 relative to the tube 70*b*. The opening communicating with the airflow inlet connector 440 is communicated with the housing space 820 like the opening communicating with the intake connector 44.

Figure 4:
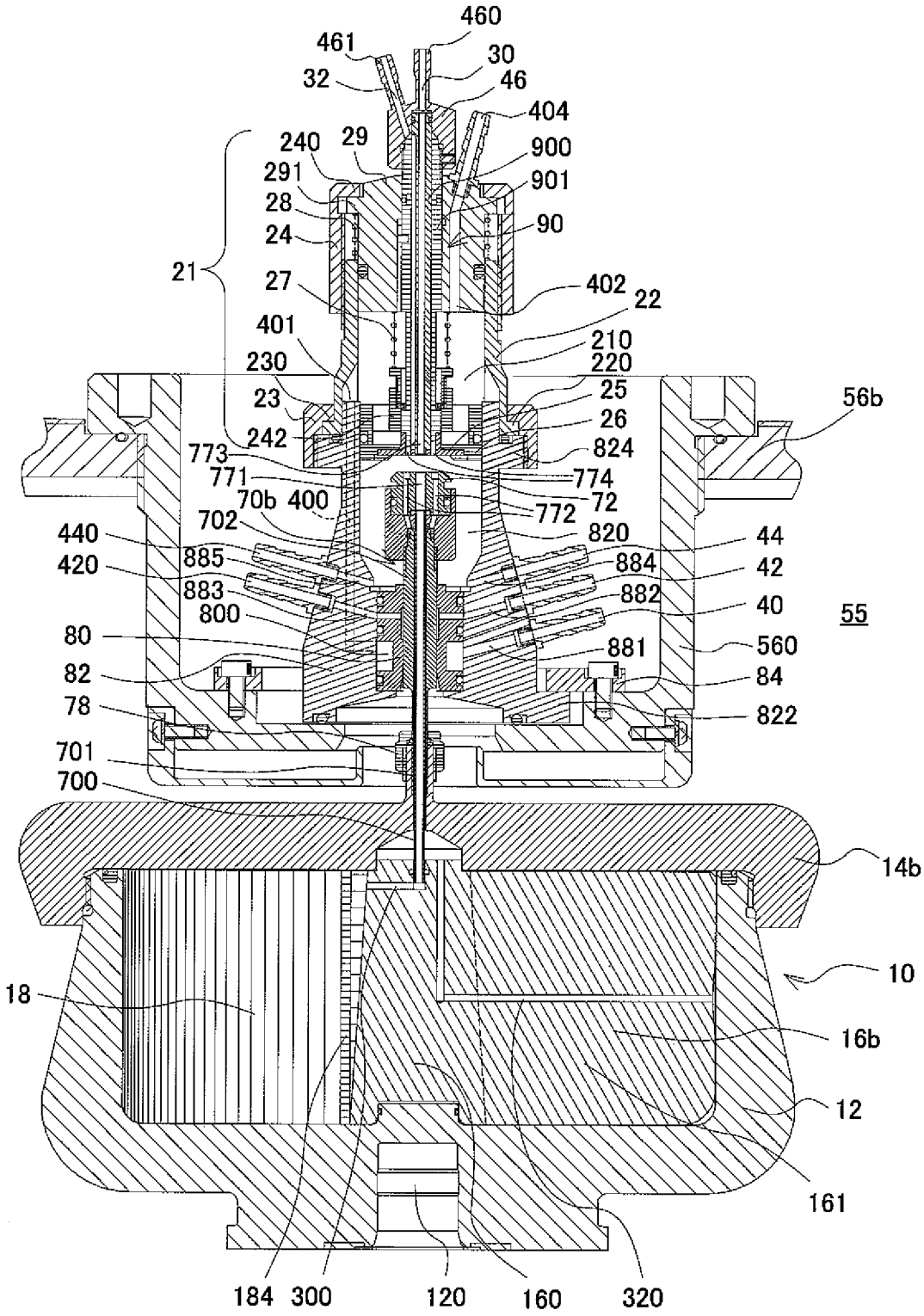
FIG. 4 is a front vertical cross-sectional view enlargingly showing the main parts of the centrifuge of the embodiment of the present invention when centrifugal separation is carried out.
Figure 5A:
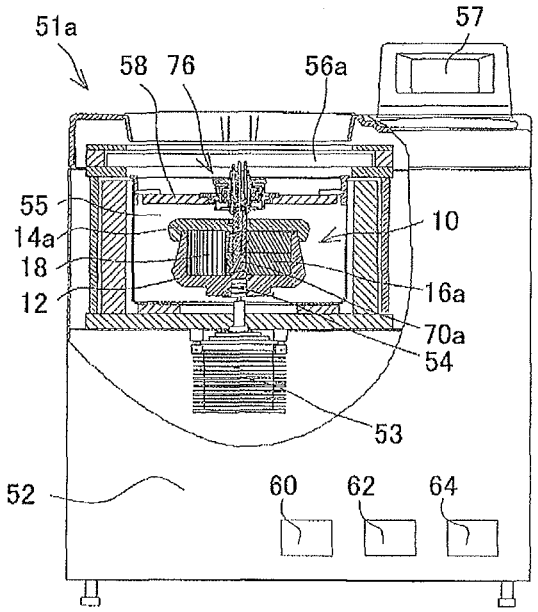
FIG. 5A CONVENTIONAL ART
FIG. 5A is a front vertical cross-sectional view showing a conventional centrifuge when a sample is filled/collected.
Figure 5B:
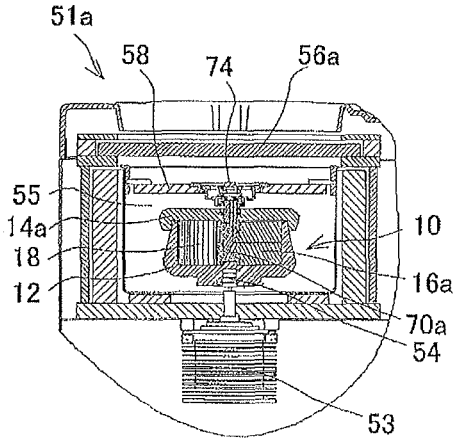
FIG. 5B CONVENTIONAL ART
FIG. 5B is a front vertical cross-sectional view showing the conventional centrifuge when centrifugal separation is carried out.
Figure 6:
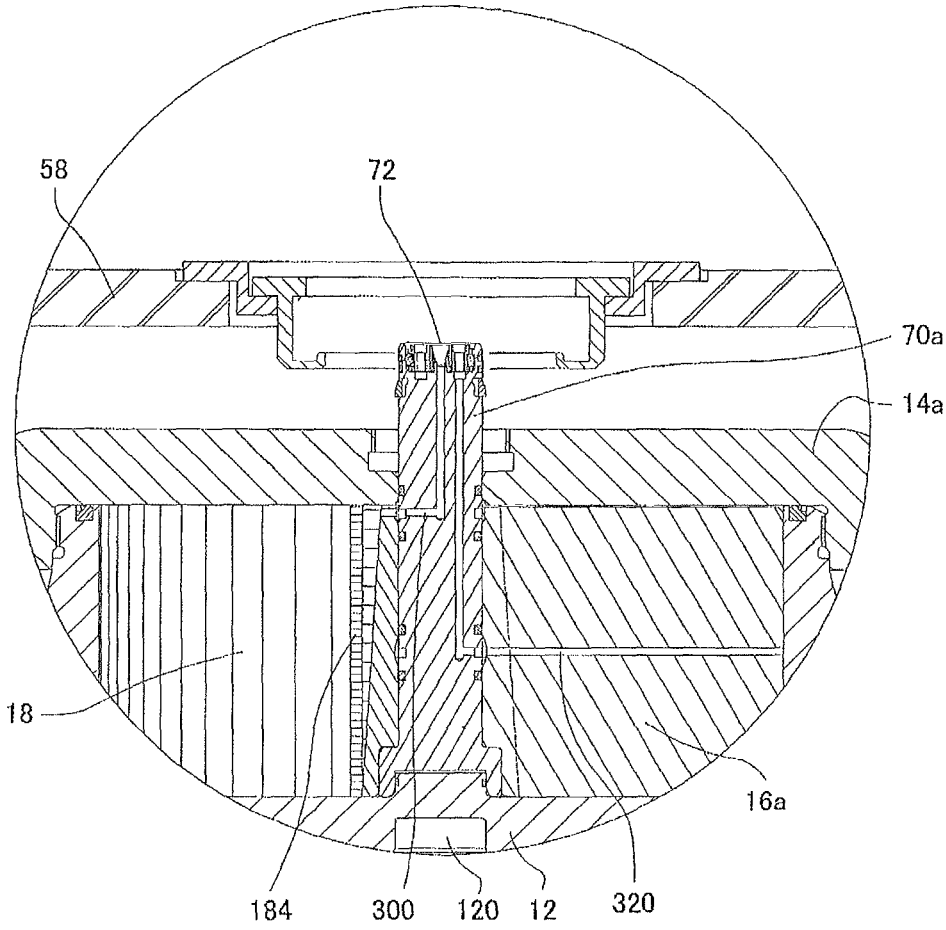
FIG. 6 CONVENTIONAL ART
FIG. 6 is a front vertical cross-sectional view enlargingly showing main parts of the conventional centrifuge.

Next, an explanation will be given of the mechanical seal member 21 of the embodiment. The mechanical seal member 21 has a function of joining and separating the fixing seal 25 to be discussed later and the rotating seal 72 from each other and of connecting/disconnecting the sample passageway 300 and a sample passageway (third passageway) 30 to be discussed later, and, the extrusion liquid passageway 320 and an extrusion liquid passageway (fourth passageway) 32, between a state where the sample 184 mainly shown in FIG. 3 is filled/collected and a state where centrifugal separation shown in FIG. 4 is carried out. As shown in FIGS. 3 and 4, the mechanical seal member 21 mainly comprises a sleeve 22 to be discussed later, a lower collar 23 which fastens the sleeve 22 with the bearing housing 82, a pressing member (tube fixing member) 29 which slides in the sleeve 22, an upper collar (operating member) 24 which fastens the pressing member 29 with the sleeve 22, an upper tube 90 (second tube) fitted to the center of the pressing member 29, and a follower member 242 which followingly moves in accordance with movement of the pressing member 29. Individual members will be explained in detail below.

The sleeve 22 is formed in a substantially cylindrical shape, has a larger-diameter part 220 formed at a lower end thereof, and has a male thread formed on an upper end face. The sleeve 22 slidably supports the pressing member 29 to be discussed later.

The lower collar 23 has a function of connecting the sleeve 22 and the bearing housing 82. The lower collar 23 is formed in a substantially cylindrical shape having a through hole at the center. The lower collar 23 has an abutment part 230 protruding inwardly of the through hole at an upper part of the lower collar 23, and has a female thread formed at an internal side face of a lower part. As the abutment part 230 abuts the upper protrusive part 824 of the bearing housing 82 and the female thread of the lower collar 23 is fastened with the male thread of the bearing housing 82, the sleeve 22 is connected to the bearing housing 82 in a manner that the larger-diameter part 220 of the sleeve 22 is sandwiched.

The pressing member 29 is formed in a substantially cylindrical shape, has a through hole formed in the center thereof where the upper tube 90 to be discussed later is fitted in, and has a larger-diameter part 291 formed at a part of a side face. An upper spring (elastic member) 28 which is a coil spring is provided between the larger-diameter part 291 of the pressing member 29 and an upper face of the sleeve 22. The upper spring 28 biases the pressing member 29 upwardly so that the pressing member 29 abuts the upper collar 24 to be discussed later. Selected for the upper spring 28 is one which has an appropriate size and elastic force so that a seal face of the rotating seal 72 and that of the fixing seal 25 contact with each other when the upper collar 24 is fastened and the seal face of the rotating seal 72 and that of the fixing seal 25 become apart from each other when the upper collar 24 is loosened. A coolant opening 402 which passes all the way through a part of the pressing member 29 from the downward direction to the upward direction is formed. The coolant opening 402 is provided in order to drainage the coolant which has cooled down the fixing seal 25 to be discussed later to the exterior. The coolant opening 402 is communicated with the coolant outlet connector 404 opened to the exterior of the centrifuge 51*b*.

The upper collar 24 has a function of moving the pressing member 29 in the vertical direction. The upper collar 24 is formed in a substantially cylindrical shape having a through hole at the center thereof. The upper collar 24 has an abutment part 240 which abuts the larger-diameter part 291 of the pressing member 29 and formed at an upper part, and has a female thread corresponding to the male thread of the sleeve 22 and formed at an internal side face of a lower part. As the abutment part 240 abuts the larger-diameter part 291 of the pressing member 29 and the female thread of the upper collar 24 is fastened with the male thread of the sleeve 22, the upper collar 24 biases a protrusive part of the pressing member 29 downwardly, and the pressing member 29 is moved downwardly against biasing of the upper spring 28. In contrast, as the female thread of the upper collar 24 is screwed down from the male thread of the sleeve 22, the upper spring 28 pushes the protrusive part of the pressing member 29 upwardly, so that the pressing member 29 is moved upwardly.

The upper tube 90 has a function of introducing a filled density gradient liquid, sample 184 and extrusion liquid into the lower tube 70*b* and a function of guiding the sample 184 to be collected from the lower tube 70*b*. The upper tube 90 has a dual tube configuration comprised of a cylindrical inner tube 900 and a substantially cylindrical outer tube 901 partially having a larger-diameter part 902. The larger-diameter part 902 of the outer tube 901 is formed to have a larger diameter so that it can be appropriately fitted into the foregoing pressing member 29. The fixing seal 25, which can be joining and separating from the rotating seal 72 provided at the upper end of the lower tube 70*b*, is attached to a lower end of the upper tube 90. The fixing seal 25 is formed in a substantially cylindrical shape, and has an opening (third opening) 773 communicating with the interior of the inner tube 900 and an opening (fourth opening) 774 communicating with a space between the inner tube 900 and the outer tube 901.

A filling/collecting adapter 46 having a sample inlet/outlet connector 460 and an extrusion liquid inlet connector 461 is fitted to an upper end of the upper tube 90. The sample inlet/outlet connector 460 has an opening communicating with the inner tube 900. The extrusion liquid inlet connector 461 has an opening communicating with a space between the inner tube 900 and the outer tube 901. The filling/collecting adapter 46, the upper tube 90, and the fixing seal 25 having the foregoing configurations form the sample passageway 30 which runs from the sample inlet/outlet connector 460 to the fixing seal 25 via the inner tube 900. Moreover, the extrusion liquid passageway 32 which runs from the extrusion liquid inlet connector 461 to the fixing seal 25 through a space between an external face of the inner tube 900 and an internal face of the outer tube 901 is also formed.

The follower member 242 has a fixing seal body 26 which supports the fixing seal 25 at a central lower face. A lower coil spring 27 which is a coil spring is provided between the follower member 242 and the pressing member 29. The follower member 242 is biased as the lower spring 27 expands or contracts in accordance with a position of the pressing member 29, and slides over the internal face of the bearing housing 82. Selected for the lower spring 27 is one which has an appropriate size and elastic force so that the seal face of the rotating seal 72 and that of the fixing seal 25 contact with each other when the upper collar 24 is fastened and the seal face of the rotating seal 72 and that of the fixing seal 25 are apart from each other when the upper collar 24 is loosened. Depending on a position of the follower member 242, the fixing seal 25 becomes joined and separated from the rotating seal 72. Further, regardless of the deformation amount, the lower spring 27 is set in such a way that the fixing seal 25 is pressed against the rotating seal 72 with almost constant pressing force. Accordingly, the fixing seal 25 is not pressed against the rotating seal 72 beyond necessity, and the contact pressure is maintained almost constant. Since the fixing seal 25 closely contacts the rotating seal 72 which is in rotation when the sample 184 is filled/collected, heat is generated at a sliding face between the rotating seal 72 and the fixing seal 25. Accordingly, a seal cooling space 210 is provided for cooling down the fixing seal 25 by contacting a coolant to the fixing seal 35. The seal cooling space 210 is segmented by the fixing seal body 26, the bearing housing 82, the sleeve 22, and the pressing member 29. Moreover, contact pressure of the fixing seal 25 and the rotating seal 72 can be given by an addition of the elastic force of the lower spring 27 and water pressure when water flows.

Next, an explanation will be given of an operation of the centrifuge of the embodiment.

First, a step of filling a sample will be explained. The control panel 57 is manipulated to vacuum (depressurize) the rotor rotation chamber 55, and to cause the drive unit 53 shown in FIG. 1 to rotate the rotor 10 at about 3000 rpm. Next, the upper collar 24 shown in FIG. 3 is screwed in the sleeve 22 to move the pressing member 29 downwardly. The pressing member 29 moves downwardly, while at the same time, the upper tube 90 fitted to the pressing member 29 also moves downwardly. Then, the fixing seal 25 attached to the lower end of the upper tube 90 is joined with the rotating seal 72 attached to the upper end of the lower tube 70*b*. In this fashion, the sample passageway 30 and the sample passageway 300 are connected together. Next, using a liquid-feeding pump (not shown), a density gradient liquid necessary for separating a sample and the sample 184 subject to separation are filled from the sample inlet/outlet connector 460. FIG. 2B is a schematic view showing the interior of the rotor 10 when the density gradient liquid is filled. The figure shows a state where three steps of density gradient liquids (181, 182, and 183 in the order of higher specific gravity) are filled. Thereafter, the sample 184 subject to separation is filled from the sample inlet/outlet connector 460 which is shown in FIG. 3 and communicated with the center of the rotor 10 via the sample passageway 300. Furthermore, a liquid 185 having a lighter specific gravity than that of the sample 184 is filled to perpendicularly raise the sample 184 subject to separation as shown in FIG. 2B. A preparation for centrifugal separation is completed through the foregoing works.

Next, a step of performing centrifugal separation will be explained. As the upper collar 24 is rotated in a direction in which the fastening with the sleeve 22 is loosened following to the sample-filled state shown in FIG. 3, the upper collar 24 is moved upwardly. The pressing member 29 urged toward the upper collar 24 by the upper spring 28 also moves upwardly while abutting the upper collar 24. Further, the upper tube 90 fitted to the pressing member 29 also moves upwardly, and the fixing seal 25 attached to the lower end of the upper tube 90 also moves upwardly. Accordingly, as shown in FIG. 4, the fixing seal 25 of the upper tube 90 becomes apart from the rotating seal 72 of the lower tube 70*b*, thus suppressing generation of any large sliding friction originating from the joining of both seals when the rotor 10 is rotating at high speed. Next, the rotor rotation chamber 55 is vacuumed, the rotation speed of the rotor 10 is increased to a predetermined rotation speed, and centrifugal separation with a time appropriate for separating the sample 184 is then carried out.

Next, a step of collecting the sample 184 will be explained. The rotation speed of the rotor 10 is reduced to 3000 rpm again. Next, as the upper collar 24 is screwed in the sleeve 22, the pressing member 29 is caused to move downwardly. The pressing member 29 moves downwardly, while at the same time, the upper tube 90 fitted to the pressing member 29 moves downwardly. This causes the fixing seal 25 attached to the lower end of the upper tube 90 to contact the rotating seal 72 attached to the upper end of the lower tube 70*b*. In this fashion, the sample passageway 30 and the sample passageway 300, and, the extrusion liquid passageway 32 and the extrusion liquid 320 are respectively connected together. Next, an extrusion liquid is filled from the extrusion liquid connector 461. The filled extrusion liquid flows into the external side (internal side-face side of the rotor body 12) of the sample storage chamber 18 through the extrusion liquid passageway 32 and the extrusion liquid passageway 320. The flowing extrusion liquid pushes the sample 184 from the external side of the sample storage chamber 18 to the internal side thereof. The pushed sample 184 is pushed out from the sample inlet/outlet connector 460 through the sample passageway 300 and the sample passageway 30, and then collected. The density gradient liquid containing settling particles can be dividingly collected by a fraction collector while continuously measuring a light absorption degree through a spectrophotometric meter or the like. In the successive foregoing steps, the rotor rotation chamber 55 is airtightly sealed from the atmosphere by the lubricant filled in a space between the oil bearing 80 and the bearing housing 82.

A step of monitoring any leakage of the sample 184 will be explained. An air filter (not shown) is connected in front of the airflow inlet connector 440 shown in FIGS. 3 and 4 to make it possible to provide clean air from the airflow inlet connector 440. Next, suctioning is carried out from the intake connector 44 through the housing space 82 using a suction pump, and the suctioned air is fed to an intake line. As the condition of the intake line is visually observed, any leakage caused by a contact failure of the rotating seal 72 and the fixing seal 25 can be monitored. Moreover, the air suctioned by the suction pump is cleanly exhausted through the air filter. Further, an inert gas (e.g., a nitrogen gas) may be supplied from the airflow inlet connector 440.

A step of cooling down the oil bearing 80 and the fixing seal 25 both generating heats will be explained. A coolant supplied from the coolant inlet connector 40 cools down the external face of the oil bearing 80, and then enters the seal cooling space 210 of the mechanical seal member 21 from the coolant outlet 401 provided at the upper end of the bearing housing 82 through the coolant opening 400 formed in the bearing housing 82. The coolant entering the seal cooling space 210 cools down a side of the fixing seal 25 opposite to a side facing the rotating seal 72, and is drained to the exterior of the centrifuge 51*b* through the coolant opening 402 formed in the pressing member 29 and the coolant outlet connector 404.

The centrifuge 51*b* of the embodiment has the mechanical seal member 21 which causes the rotating seal 72 of the rotor 10 and the fixing seal 25 of the mechanical seal member 21 not to be in contact with each other when the rotor 10 shown in FIGS. 1 and 4 is rotating at high speed (at the time of centrifugal separation). This extends the lifetime of the rotating seal 72 and that of the fixing seal 25 which are shortened by sliding friction.

Since the space between the oil bearing 80 and the bearing housing 82 is filled with the lubricant, the rotor rotation chamber 55 can be always decoupled from the atmosphere. This suppresses any inflow of air from the above of the oil bearing 80 even if the rotor rotation chamber 55 is vacuumed when the rotor 10 is rotating at high speed. Thus, the vacuuming condition of the rotor rotation chamber 55 can be maintained.

The joining and separation of the rotating seal 72 and the fixing seal 25 can be adjusted by the upper collar 24 which is present in the atmosphere without directly touching a space where the sample is present. As the bearing housing 82 and the mechanical seal member 21 are combined together, as shown in FIG. 3, the surroundings around the seal faces can be a sealed space. The adjustment of the joining and separation of the rotating seal 72 and the fixing seal 25 utilizes a screwing connection of the upper collar 24 and the sleeve 22 in the embodiment. However, other techniques can be used if such a purpose can be accomplished, and the same effect can be achieved in this case. For example, a sealed space may be formed around the upper collar 24, and the position of the upper collar 24 may be adjusted by the pressure of air supplied to the sealed space. This enables remote setting of the air pressure and remote adjustment of the joining and separation.

The explanation has been given of the configuration that the fixing seal 25 becomes joined and separated from the rotating seal 72 in the embodiment, but the functional contribution can be freely changed if the fixing seal 25 and the rotating seal 72 can be joined and separated from each other, and a configuration that the rotating seal 72 becomes joined and separated from the fixing seal 25 may be employed.

There is no problem if the intake connector 44 and the airflow inlet connector 440 are not equipped. However, by providing such connectors, it becomes possible to monitor any leakage caused by a contact failure of the rotating seal 72 and the fixing seal 25, so that the maintenance of the centrifuge 51*b* is facilitated. According to the embodiment, air passing through the air filter is caused to flow in from the airflow inlet connector 440, and is exhausted from the intake connector 44 through the filter. Accordingly, even if the mechanical seal member 21 is falsely attached or seal-relating parts are worn or damaged, it is possible to suppress any inflow of contaminated substances in air into the sample passageway, thus suppressing any contamination of the sample 184.

Furthermore, by equipping the coolant inlet connector 40, the coolant openings 400, 401, the coolant outlet 401, and the coolant outlet connector 404, a coolant can be guided to the oil bearing 80 and the fixing seal 25 to efficiently cool down those parts.

Note that members configuring the rotating seal 72, the fixing seal 25 and the mechanisms thereof are formed of a metal or a plastic which can be tolerant of heat at least 121° C. Accordingly, even when the sample 184 leaks because of a failure of such a part and the surroundings of such a part are contaminated by the sample 184, if vapor steam is introduced from the airflow inlet connector 440, steam sterilization for 20 minutes can be carried out at 121° C. by controlling a temperature and pressure at the intake connector 44 side. This enables the user to easily sterilize the surroundings of the seal faces, so that the user can work efficiently when disassembling and cleaning the centrifuge 51*b*.

As the fastening of the lower collar 23 and the bearing housing 82 is loosened and those parts are disassembled from each other, the mechanical seal member 21 can be removed from the bearing housing 82, so that the centrifuge 51*b* of the embodiment has good maintenance property and accommodation property.

The centrifuge 51*b* of the embodiment has the space between the oil bearing 80 and the bearing housing 82 where the lubricant is filled, and the rotor rotation chamber 55 is separated from the housing space 820 by the lubricant. The fixing seal 25 and the rotating seal 72 can be joined and separated from each other within the housing space 820, so that it is not necessary to open the rotor rotation chamber 55. Accordingly, a pressure in the rotor rotation chamber 55 can be reduced right after the operation is started (a start switch of the control panel 57 is turned ON) without causing any dew condensation inside the rotor rotation chamber 55, so that the operation time can be shortened (the pressure of the rotor rotation chamber 55 can be reduced while the rotor 10 is rotated at 3000 rpm and a density gradient liquid and the sample 184 are filled). Further, regardless of any effect of the atmosphere, the temperature of the interior of the rotor rotation chamber 55 can be controlled precisely.

Although the explanation has been given on a case in the embodiment where the centrifuge 51*b* of the embodiment has one sample passageway 300 and one extrusion liquid passageway 320 in the septa 16*b*, a plurality of such passageways may be formed respectively.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2008-255740 filed on Sep. 30, 2008, and including specification, claims, drawings and summary. The disclosure of the above Japanese Patent Application is incorporated herein by reference in its entirety.

What is claimed is:

1. A centrifuge comprising:

a rotor having a sample storage chamber configured to store a sample;

a rotor rotation chamber in which the rotor is provided;

a driving unit configured to rotate the rotor;

a first tube having one end connected to the sample storage chamber, and having another end where a first seal member is provided;

a second tube arranged to face the first tube;

a second seal member arranged at one end of the second tube;

a first supporting member arranged over the rotor, and configured to rotatably support the first tube;

a second supporting member configured to movably support the second tube in a direction toward the first tube and in a direction way from the first tube; and an operation member formed in a cylindrical shape and provided rotatably on the second supporting member;

wherein the second seal member is configured such that when the operation member is rotated, the second seal member moves between a first position wherein the second seal member is not in contact with the first seal member and a second position where the second seal member is in contact with the first seal member.

2. The centrifuge according to claim 1, further comprising:

an elastic member configured to apply force to the second supporting member to move in a direction away from the first supporting member.

3. The centrifuge according to claim 1, wherein the first tube includes a first passageway configured to fill and collect the sample in the sample storage chamber and a second passageway configured to fill a liquid configured to push the sample out of the first passageway.

4. The centrifuge according to claim 3, wherein the first supporting member comprises:

a bearing configured to be rotatable and to support the first tube; and a bearing supporting member formed in a cylindrical shape, and configured to support the bearing;

wherein the second supporting member comprises:

a cylindrical sleeve having one end connected to the bearing supporting member, and another end provided with a threaded face;

a tube fixing member slidably fitted to an internal face of the sleeve; and an elastic member arranged between the sleeve and the tube fixing member, and configured to move the tube fixing member toward a direction away from the first tube; and wherein the operation has one end provided with a threaded face corresponding to the threaded face of the sleeve, and has another end provided with an abutment part which abuts another end of the tube fixing member.

5. The centrifuge according to claim 4, wherein the second seal member connected to the second tube is configured to move to abut the first seal member when the operation member is rotated in one direction and the second seal member is configured to move in a direction away from the first seal member when the operation member is rotated in the other direction.

6. The centrifuge according to claim 4, wherein a lubricant filled in a space between the first tube and the bearing is configured to separate the rotor rotation chamber from atmosphere, thus a depressurized condition is maintained when an interior of the rotor rotation chamber is depressurized.

7. The centrifuge according to claim 4, wherein the first seal member is provided in a sealed space.

8. The centrifuge according to claim 7, wherein the sealed space is formed by the first tube, the bearing, the bearing supporting member, and the second seal member.

9. The centrifuge according to claim 8, wherein the bearing support member has two openings which are configured to communicate with the sealed space, one opening of the two openings being configured to allow air to flow into the sealed space through a filter, and the other opening configured to allow suctioned air to be exhausted through another filter.

10. The centrifuge according to claim 7, wherein a member contacting the sealed space is formed of a metal or a plastic.

11. The centrifuge according to claim 4, wherein the bearing supporting member has an opening configured to reach the bearing and configured to supply a lubricant to the bearing.

12. The centrifuge according to claim 4, wherein the bearing supporting member has an opening configured to reach the bearing and configured to supply a lubricant to the bearing.

13. The centrifuge according to claim 1, wherein a second seal member is configured to move to abut the first seal member and to move away from the first seal member with the rotor rotation chamber being in a depressurized condition.

14. A centrifuge comprising:

a rotor having a sample storage chamber configured to store a sample;

a rotor rotation chamber in which the rotor is provided;

a driving unit configured to rotate the rotor;

a first tube which has one end connected to the sample storage chamber, and has a first passageway and a second passageway, the first passageway configured to fill a density gradient liquid and the sample in the sample storage chamber and configured to collect the sample in the sample storage chamber, and the second passageway configured to fill a liquid configured to push out the sample in the sample storage chamber to the first passageway;

a first seal member which is connected to another end of the first tube, and has a first opening and a second opening configured to communicate with the first passageway and the second passageway, respectively;

a second seal member which is so arranged as to face the first seal member, and has a third opening and a fourth opening which face the first opening of the first seal member and the second opening thereof, respectively;

a second tube which has a third passageway having one end connected to the second seal member and configured to communicate with the third opening, and a fourth passageway configured to communicate with the fourth opening; and a joining/separating member configured to join and separate the first seal member and the second seal member;

wherein as the first seal member and the second seal member are joined together by the joining/separating member, the first passageway and the first opening become configured to communicate with the third opening and the third passageway, and the second passageway and the second opening become configured to communicate with the fourth opening and the fourth passageway, so that the sample storage chamber of the rotor becomes accessible through the third passageway and the fourth passageway;

wherein as the first seal member and the second seal member are separated from each other by the joining/separating member, the first passageway and the first opening are separated from the third opening and the third passageway, and the second passageway and the second opening are separated from the fourth opening and the fourth passageway;

wherein the joining/separating member includes:

a first supporting member arranged over the rotor, and rotatably supporting the first tube; and a second supporting member configured to movably support the second tube in a direction toward the first tube and in a direction apart from the first tube; and an operation member;

wherein the second seal member is configured to move in accordance with a manipulation of the operation member, and is configured to abut and slide the first seal member which is configured to rotate along with rotation of the rotor;

wherein the first supporting member includes:

a bearing which is arranged over the rotor, and is configured to rotatably support the first tube; and a bearing supporting member formed in a cylindrical shape, and having an internal face configured to support the bearing; and wherein the second supporting member comprises:

a cylindrical sleeve which has one end connected to the bearing supporting member, and has another end provided with a threaded face, a tube fixing member which is formed in a cylindrical shape, has an internal face fixing the second tube, has one end slidably fitted to an internal face of the sleeve, and has another end provided with a larger-diameter part, and an elastic member arranged between the sleeve and the larger-diameter part of the tube fixing member, and configured to move the tube fixing member toward a direction apart from the first tube; and wherein the operation member is formed in a cylindrical shape, has one end provided with a threaded face corresponding to the threaded face of the sleeve, and has another end provided with an abutment part which abuts another end of the tube fixing member.

15. The centrifuge according to claim 14, wherein:

as the operation member is fastened to the sleeve, the joining/separating member causes the abutment part of the operation member to abut another end of the tube fixing member and to push the tube fixing member, causes the tube fixing member to move the second tube and the second seal member connected to the second tube in a direction toward the first tube, and causes the second seal member to abut and slide the first seal member which is configured to rotate along with rotation of the rotor; and as the operation member is loosened from the sleeve, the joining/separating member causes the tube fixing member to be urged in a direction opposite to an axis of the first tube, causes the tube fixing member, the second tube and the second seal member connected to the second tube to move in a direction apart from the first tube, and causes the second seal member to be apart from the first seal member which is configured to rotate along with the rotation of the rotor.

16. The centrifuge according to claim 14, wherein a lubricant filled in a space between the first tube and the bearing separates the rotor rotation chamber from atmosphere, thus a depressurized condition is maintained when an interior of the rotor rotation chamber is depressurized.

17. The centrifuge according to claim 14, wherein the first seal member is provided in a sealed space.

18. The centrifuge according to claim 17, wherein the sealed space is formed by the first tube, the bearing, the bearing supporting member, and the second seal member.

19. The centrifuge according to claim 18, wherein:

two openings which are configured to communicate with the sealed space are formed in the bearing supporting member;

one opening allows air passing through a filter to flow in;

another opening suctions the air; and the air suctioned through another opening is exhausted through another filter.

20. The centrifuge according to claim 17, wherein a member contacting the sealed space is formed of a metal or a plastic which is a tolerant of heat at 121 ° C.

21. The centrifuge according to claim 14, wherein the bearing supporting member has openings which reaches the bearing and from which a lubricant is supplied and/or collected.

22. The centrifuge according to claim 14, wherein the bearing supporting member has an opening which reaches the bearing and from which a coolant is supplied.

* * * * *